US011230426B2

(12) United States Patent
Martin et al.

(10) Patent No.: US 11,230,426 B2
(45) Date of Patent: Jan. 25, 2022

(54) CHILD-RESISTANT SINGLE PILL DISPENSER

(71) Applicant: BAYER HEALTHCARE LLC, Indianola, PA (US)

(72) Inventors: Joseph Martin, Morristown, NJ (US); Eric Schmidt, Wheaton, IL (US); Robert G. Petit, Grafton, MA (US)

(73) Assignee: BAYER HEALTHCARE LLC, Whippany, NJ (US)

( * ) Notice: Subject to any disclaimer, the term of this patent is extended or adjusted under 35 U.S.C. 154(b) by 0 days.

(21) Appl. No.: 16/607,137

(22) PCT Filed: Apr. 19, 2018

(86) PCT No.: PCT/US2018/028273
§ 371 (c)(1),
(2) Date: Oct. 22, 2019

(87) PCT Pub. No.: WO2018/200302
PCT Pub. Date: Nov. 1, 2018

(65) Prior Publication Data

US 2020/0047979 A1 Feb. 13, 2020

Related U.S. Application Data

(60) Provisional application No. 62/489,648, filed on Apr. 25, 2017, provisional application No. 62/503,547, filed on May 9, 2017.

(51) Int. Cl.
*B65D 43/20* (2006.01)
*B65D 83/04* (2006.01)

(52) U.S. Cl.
CPC ..... *B65D 83/0409* (2013.01); *B65D 43/20* (2013.01); *B65D 2215/02* (2013.01); *B65D 2583/0454* (2013.01)

(58) Field of Classification Search
None
See application file for complete search history.

(56) References Cited

U.S. PATENT DOCUMENTS 5,018,644 A 5/1991 Hackmann et al.
5,816,441 A * 10/1998 Farside ..... B65D 83/0409 221/152

(Continued)

FOREIGN PATENT DOCUMENTS

CA 2429110 A1 11/2004
DE 3143197 A1 5/1983

(Continued)

OTHER PUBLICATIONS

"International Preliminary Report on Patentability & Written Opinion from corresponding PCT Application PCT/US2018/028273 dated Sep. 3, 2018".

(Continued)

*Primary Examiner* — Gene O Crawford
*Assistant Examiner* — Ayodeji T Ojofeitimi
(74) *Attorney, Agent, or Firm* — Morrison & Foerster LLP

(57) ABSTRACT

A child-resistant dispenser includes a housing (110); and a slider (150) disposed on the housing and configured to slide from a closed position to a dispensing position, the slider comprising a movable engagement portion (148) that engages a stop (122) on the housing, wherein the engagement between the movable engagement portion and the stop restricts movement of the slider to the dispensing position and the movable engagement portion is configured to disengage from the stop in response to a release force applied to the slider.

17 Claims, 8 Drawing Sheets

(56) References Cited

U.S. PATENT DOCUMENTS

| | | | | |
|---|---|---|---|---|
| 5,975,349 | A * | 11/1999 | Menes | B65H 1/06 221/232 |
| 6,273,294 | B1 | 8/2001 | Petzold et al. | |
| 9,636,279 | B2 * | 5/2017 | Song | A61J 7/0076 |
| 2005/0199527 | A1 | 9/2005 | Ellis et al. | |
| 2007/0000938 | A1 | 1/2007 | Renaud | |
| 2008/0142540 | A1 * | 6/2008 | Chang | B65H 3/02 221/259 |
| 2010/0147869 | A1 * | 6/2010 | Iliffe | B65D 83/10 221/232 |
| 2011/0226772 | A1 | 9/2011 | Adler et al. | |
| 2018/0257827 | A1 * | 9/2018 | Drosos | B65D 5/38 |

FOREIGN PATENT DOCUMENTS

| | | | |
|---|---|---|---|
| DE | 8815878 | U1 | 10/1989 |
| WO | 2006116370 | A2 | 11/2006 |

OTHER PUBLICATIONS

"International Preliminary Report on Patentability from corresponding PCT Application PCT/US2018/024437 dated Oct. 1, 2019".
"International Search Report & Written Opinion from corresponding PCT Application PCT/US2018/024437 dated Aug. 21, 2018".
"International Search Report & Written Opinion from corresponding PCT Application PCT/US2018/028273 dated Sep. 3, 2018".

* cited by examiner

CHILD-RESISTANT SINGLE PILL DISPENSER

This application is the 371 national phase application of PCT International Application No. PCT/US2018/028273, filed Apr. 19, 2018, which claims priority to U.S. Provisional Patent Application No. 62/489,648, filed Apr. 25, 2017, and U.S. Provisional Patent Application No. 62/503,547, filed May 9, 2017, the disclosures of which are hereby incorporated by reference herein in their entireties.

FIELD OF THE INVENTION

This invention relates generally to dispensers and, more specifically, to child-resistant dispensers.

BACKGROUND OF THE INVENTION

Containers for dispensing solid products intended for human consumption, such as pharmaceuticals, snacks, mints, gum, candy, and the like, are often configured as hand-held containers that can be easily stored and transported. Some consumable products, such as pharmaceuticals, require containers having a certain level of child resistance. Child resistance features are intended to delay a young child's access to the contents of the container. Generally, commercially available child-resistant packaging designs rely upon working principles that require a combination of: hand-finger strength, hand-finger dexterity, and specific cognitive abilities. For example, pharmaceutical pills are often packaged in a bottle having a cap that can only be removed by applying downward pressure while twisting the cap. The downward pressure requires a certain level of strength, the combination of downward pressure and twisting requires a certain level of dexterity, and the combination of downward pressure and twisting is not intuitive and is unlikely to be discovered by accident, thus requiring a certain level of cognitive ability.

Conventional bottles with twist-and-press caps have certain disadvantages. For example, if a child does manage to open the bottle, immediate access is provided to the entire contents of the bottle. Further, if an adult user fails to place the cap in the properly secured position, there is no secondary mechanism for preventing access by a child. Some aged adults or adults with disabilities may lack sufficient strength or dexterity to open the twist-and-press caps. Additionally, extracting the right amount of product once the cap is removed may be difficult for those with reduced dexterity who may not be able to reach into the bottle to pull out the desired amount of product. The contents of the container may be poured out, but this requires that the unused contents to be put back in the container, which may be problematic for those with reduced dexterity. Additionally, pouring the contents out also poses a risk of contamination of the unused contents.

SUMMARY OF THE INVENTION

According to some embodiments, a child-resistant dispenser is configured to provide a single unit dispense of contained product. The child-resistant features are overcome by a combination of pressing and sliding motions that can be accomplished by a single hand. The dispenser restricts access to the product contained within such that overcoming the child-resistant features results in access to a single unit of product, rather than the entire contents. According to some embodiments, the dispenser includes a slider positioned on a housing. The housing includes a dispensing chute that is uncovered as the slider moves along the housing to a dispensing position. A single unit of product positioned in the dispensing chute is dispensed from the chute when the slider moves to the dispensing position. The slider is restrained within the housing by a latch that is unlatched by a pressing force applied to the slider. The slider is moved toward its dispensing position by a force that may be applied simultaneously with the unlatching force such that dispensing requires a force and motion combination that may be difficult for a young child to perform.

According to some embodiments, a child-resistant dispenser comprises a housing; and a slider disposed on the housing and configured to slide from a closed position to a dispensing position, the slider comprising a movable engagement portion that engages a stop on the housing, wherein the engagement between the movable engagement portion and the stop restricts movement of the slider to the dispensing position and the movable engagement portion is configured to disengage from the stop in response to a release force applied to the slider.

In any of these embodiments, the slider may be configured to slide to the dispensing position in response to application of a dispensing force applied to the slider when the movable engagement portion is disengaged from the stop, and the slider may be restricted from sliding to the dispensing position in response to application of the dispensing force to the slider when the movable engagement portion is engaged with the stop.

In any of these embodiments, the dispenser may be configured such that the release force and the dispensing force are applied at a single location on the slider. In any of these embodiments, the slider may include a pivoting member and the movable engagement portion may be located at an end of the pivoting member.

In any of these embodiments, the slider may include a main body and the pivoting member may be resiliently affixed to the main body such that the pivoting member is biased toward engagement with the stop. In any of these embodiments, the main body and the pivoting member may be formed as a unitary piece.

In any of these embodiments, the slider may include a connection between the main body and the pivoting member that is configured to twist as the pivoting member pivots. In any of these embodiments, the movable engagement portion may disengage from the stop by moving outward from the housing. In any of these embodiments, the slider may be configured to slide along rails on the housing.

In any of these embodiments, the housing may include a dispensing chute, and the dispenser may be configured to dispense a single unit of product from the dispensing chute when the slider is in the dispensing position. In any of these embodiments, the slider may include a protrusion that restricts additional product from moving to a dispensing location in the dispensing chute when the slider is in the dispensing position.

In any of these embodiments, the dispensing chute may include a recess for accommodating a single unit of product, and the recess may be aligned with the protrusion when the slider is in the closed position. In any of these embodiments, the housing may include a first sloping wall that intersects the dispensing chute at a first location and a second sloping wall that intersects the dispensing chute at a second location and the first location may be offset relative to the second location to orient product for entering the dispensing chute.

In any of these embodiments, the dispenser may be a handheld dispenser. In any of these embodiments, the dispenser may be configured for single-handed dispensing. In any of these embodiments, the dispenser may be configured to dispense in response to a combined inward and upward force applied to the slider by a hand. In any of these embodiments, the dispenser may be configured to dispense a single unit of product during each dispense.

According to some embodiments, a prefilled child-resistant dispenser includes a housing; a slider disposed on the housing and configured to slide from a closed position to a dispensing position, the slider comprising a movable engagement portion that engages a stop on the housing; and product contained within the dispenser for dispensing by the dispenser, wherein the engagement between the movable engagement portion and the stop restricts movement of the slider to the dispensing position and the movable engagement portion is configured to disengage from the stop in response to a first release force applied to the slider.

In any of these embodiments, the dispenser may include packaging encasing the housing and the slider.

According to some embodiments, a method of dispensing a unit of product from a dispenser that comprises a housing and a slider disposed on the housing may include moving at least a portion of an engagement portion of the slider to release an engagement between the slider and the housing that prevents the slider from moving to a dispensing position; and while the engagement is released, moving the slider along a side of the housing to a dispensing position in which a single unit of product is dispensed.

In any of these embodiments, moving at least a portion of an engagement portion of the slider to release an engagement between the slider and the housing may include applying a first force to the slider. In any of these embodiments, the first force or a second force applied to the slider may move the slider along the side of the housing once the engagement is released.

BRIEF DESCRIPTION OF THE DRAWINGS

The invention will now be described, by way of example only, with reference to the accompanying drawings, in which.

DETAILED DESCRIPTION OF EXEMPLARY EMBODIMENTS

Described below are embodiments of dispensers that include single product unit dispensing with a combination of dispensing motions of sufficient complexity to resist dispensing of the product by a young child, while allowing one-handed dispensing by an adult. Dispensers may restrict access to the product contained within such that overcoming the child-resistant features results in access to just a single unit of product, rather than the entire contents. According to some embodiments, the dispenser includes just two primary components—a housing and a slider disposed on the housing—which enables the dispenser to be made easily and cheaply.

According to some embodiments, the dispenser includes a slider that runs on one or more rails of the housing and includes a latch that latches the slider in a closed position on the housing. The latch may be unlatched by a pressing motion on the latch portion of the slider, which causes the latch to rotate out of engagement with the housing. Once the latch is unlatched, an upward force applied to the slider results in upward motion of the slider relative to the housing. The slider moves to a dispensing position in which a portion of a chute of the housing is uncovered, allowing a single unit of product positioned within the uncovered portion of the chute to emerge from the dispenser. In some embodiments, the slider includes an inwardly extending protrusion that aligned with a necking portion of the housing chute to prevent product from moving downward into the uncovered portion of the chute to ensure that just a single unit of product is dispensed. In some embodiments, upon release of the upward press, the slider may return to its closed position.

Figure 1:
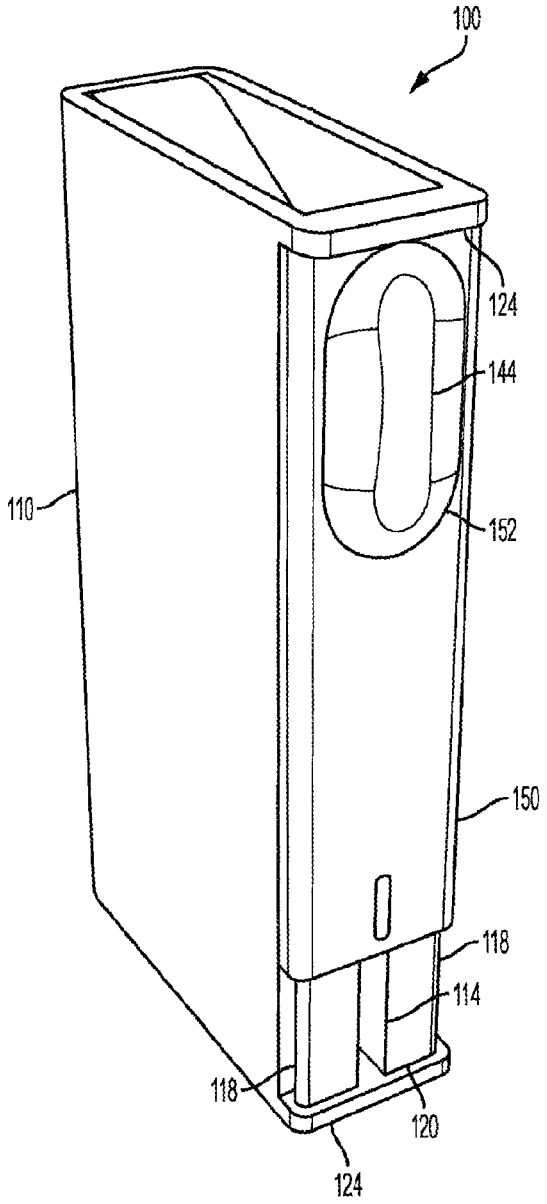
FIG. 1 is a front perspective view of a dispenser in a dispensing state according to some embodiments.

FIGS. 1-8 illustrate a child-resistant, single unit dispenser 100, according to some embodiments. Dispenser 100 includes housing 110 and slider 150 that moves up and down along the front side 120 of the housing 110 between closed and dispensing positions. FIG. 1 illustrates slider 150 positioned toward the top of housing 110 in its dispensing position. In this position, a single unit of product may be dispensed from the center bottom portion of the front side 120 of dispenser 100. Slider 150 includes a latch 152 that latches slider 150 in a closed position in which the center bottom portion of the front side 120 is covered by slider 150. As explained further below, moving slider 150 to the dispensing position illustrated in FIG. 1 for dispensing a single unit of product requires unlatching latch 152 by an inward press on the outer-facing surface of latch 152 combined with an upward force to move slider 150 to its dispensing position.

Dispenser 100 may rely at least partially upon gravity to guide product through the dispenser, and, therefore, terms such as "bottom" and "top" are used with reference to the orientation of dispenser 100 in a nominal position in which product generally gathers above the location from which product is dispensed. However, it is to be understood that dispenser 100 may be used in any suitable orientation as long as the orientation enables product to be urged toward the dispensing location of the dispenser.

Figure 2:
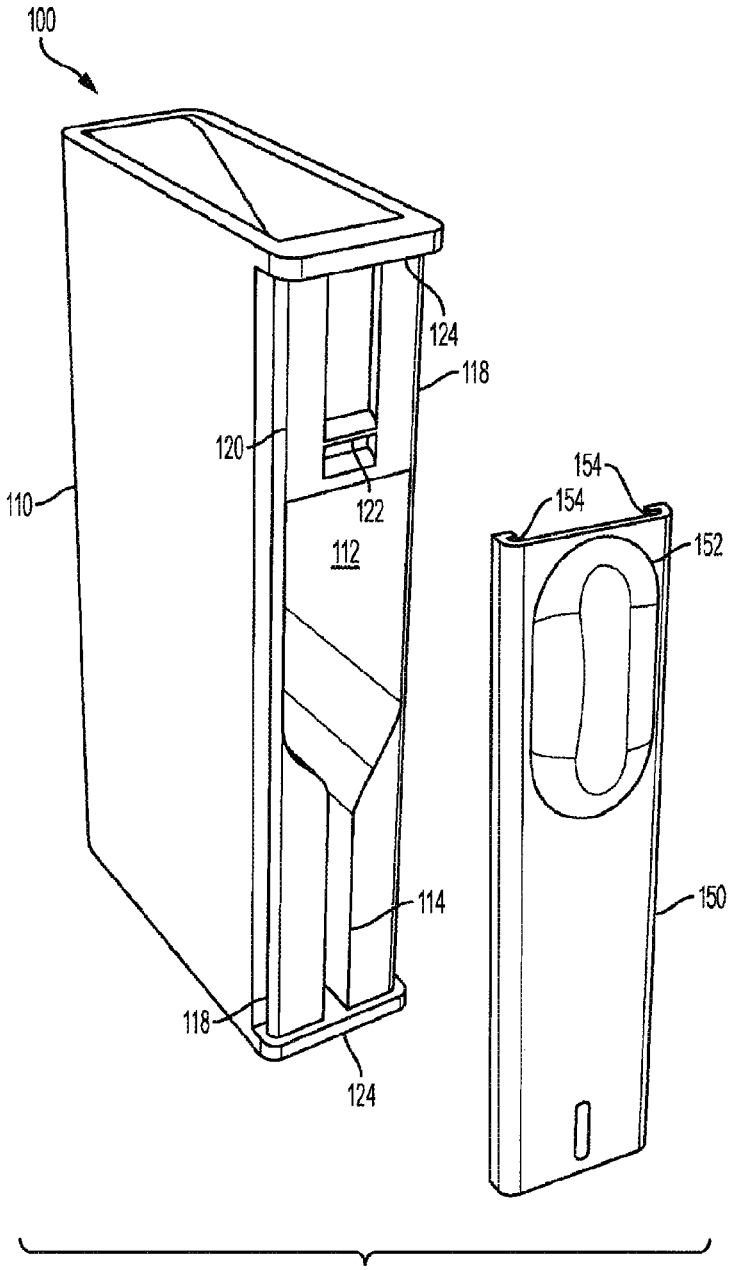
FIG. 2 is an exploded front perspective view of the dispenser of FIG. 1.

FIG. 2 is an exploded view of the dispenser of FIG. 1. Housing 110 includes a product chamber 112 in which product for dispensing by the dispenser is held and a chute 114 through which product travels for dispensing. The front side 120 of housing 110 is open along at least a portion of chute 114 and may be open along at least a portion of product chamber 112. The upper portion of the front side 120 includes a stop 122 for engaging with latch 152 of slider 150. The lateral sides of front side 120 each include a rail 118 that is engaged by respective runners 154 on slider 150 to retain slider 150 on housing 110 while allowing slider 150 to slide up and down along the front side 120 of housing 110. Rims 124 at the top and bottom ends of housing 110 may serve as stops for slider 150. In some embodiments, some other portion of the housing may serve to restrict movement of the slider. For example, one or more portions of or proximate to the opening to chamber 112 on the front side 120 of housing 110 may serve as a stops for a projection extending from the inner surface of the slider. The engagement between slider 150 and housing 110 may be configured in any other suitable manner that allows slider to slide along the housing. For example, in some embodiments, the slider may include the rails and the housing may include the runners, and in other embodiments, the sides of slider may fit within inwardly facing grooves extending along the sides of the housing.

Although illustrated as continuous, rails 118 may be discontinuous. Similarly, runners 154 may extend along the entire length of slider 150 or may extend along only a portion of the length of slider 150, either continuously or discontinuously. In some embodiments, during assembly of slider 150 to housing 110, slider 150 may flex such that runners 154 may snap over rails 118. In some embodiments, one or more of rims 124 may be a separate piece or a portion of a separate piece from housing 110 such that slider 150 may slide onto rails 118 from the top or bottom before one or more of the rims or pieces comprising the rims are assembled to the housing. For example, housing 110 may be formed from a main portion that includes rails 118 or a portion of rails 118 and a top portion that includes a top rim 124. Slider 150 may be assembled onto the rails 118 and the top portion may then be attached to the main portion of the housing. In some embodiments the dispenser may be filled with product with the top portion of housing 110 removed and final step of assembly of affixing the top portion of the housing 110 to the main portion of housing 110 may seal the product within the dispenser.

Figure 3B:
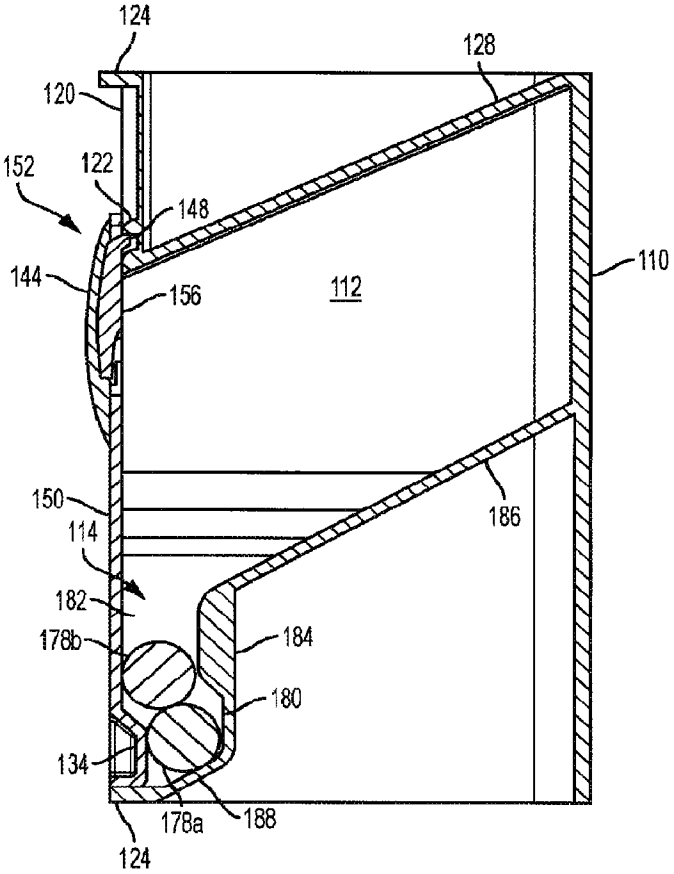
FIG. 3B is a sectional view of the dispenser of FIG. 3A.
Figure 3A:
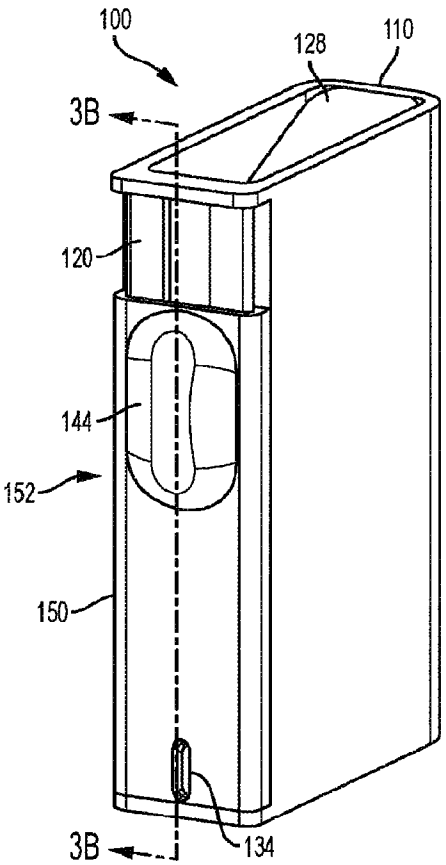
FIG. 3A is a front perspective view of a dispenser in a closed state, according to some embodiments.

FIGS. 3A and 3B are perspective and cross sectional views, respectively, illustrating dispenser 100 in the closed configuration with slider 150 positioned at the bottom of the front side 120 of housing 110. Latch 152 includes a rocker 156 that includes a protrusion 148 at the upper end. When the latch 152 is in the nominal position, as shown in FIG. 3B, protrusion 148 abuts a stop 122 extending from the front side 120 of housing 110. The engagement between protrusion 148 and stop 122 prevents slider 150 from being moved upward. With slider 150 in the closed position, chute 114 is blocked by slider 150 such that product cannot emerge from dispenser 100. The lower end of slider 150 is shown abutting rim 124 at the bottom end of housing 110, which as mentioned above, may serve as a stop for slider 150. In some embodiments, rim 124 may include a notch in the center and slider 150 may include an extension that extends into the notch. This configuration may ensure that the chute remains covered while allowing some upward-downward play of slider 150 relative to housing 110.

Exemplary product, in the form of tablets 178*a-b*, is included in chute 114 to illustrate the manner of dispensing the product in this embodiment. Tablet 178*a* is located in the lowest portion of chute 114, in a recess 180 in the distal end of chute 114. A projection in the form of rib 134, which is aligned with recess 180, projects from the inner surface of the lower portion of slider 150. The distance between rib 134 and the back of recess 180 may be configured based on the size of the tablets 178*a-b* such that the tablets can fit between rib 134 and recess 180. In the example shown, the distance between rib 134 and the back of recess 180 is slightly larger than the diameter of tablets 178*a-b*. The upper portion of rib 134 includes a ramped surface that serves to direct a tablet into recess 180. The height of recess 180 may be configured to accommodate a single unit of product (e.g., a single tablet such as tablet 178*a*) such that a second unit of product is positioned in necking section 182 of chute 114 and out of recess 180.

Necking section 182, which is located above recess 180, is formed by the inner surface of the main body of slider 150 and necking wall 184 of chute 114. The distance between the inner surface of slider 150 and necking wall 184 may be configured based on the size of the tablets 178*a-b* such that the tablets can fit into necking section 182. In the example shown, the distance between the inner surface of slider 150 and necking wall 184 is slightly larger than the diameter of tablets 178*a-b*, which allows tablet 178*b* to be positioned in necking section 182. Chute 114 includes a ramped wall 186 located at its upper end. Ramped wall 186 closes the bottom portion of chamber 112 and serves to guide product forward to necking section 182.

Housing 110 includes a top wall 128 that closes off the upper portion of chamber 112. Top wall 128 slopes downward in the illustrated embodiment but may be configured in any way, including as a horizontally extending wall. The configuration of top wall 128 may be selected based on the volume required for chamber 112. For example, the illustrated sloping of top wall 128 results in a reduced volume of chamber 112, which may be sufficient for the maximum amount of product that the dispenser may be required to contain.

Figure 4B:
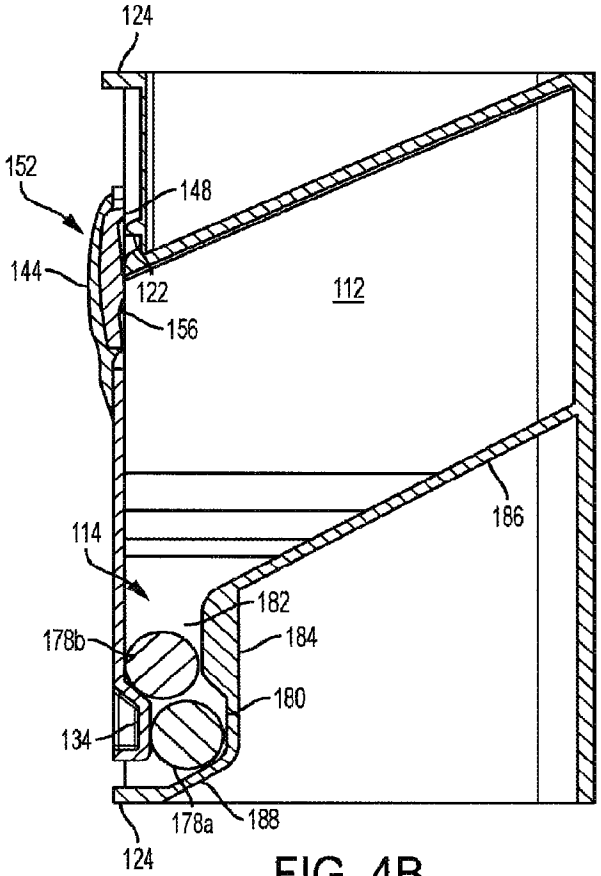
FIG. 4B is a sectional view of the dispenser of FIG. 4A.
Figure 4A:
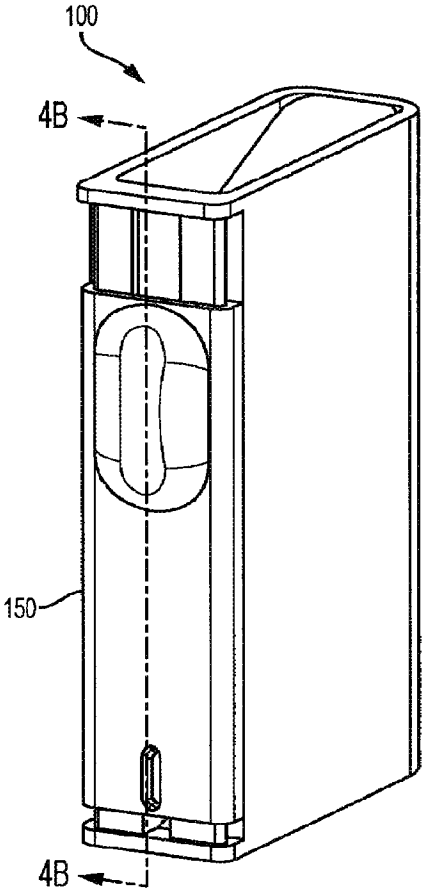
FIG. 4A is a front perspective view of the dispenser of FIG. 3A in an unlatched state.

FIGS. 4A and 4B are perspective and cross sectional views, respectively, illustrating dispenser 100 in an intermediate, unlatched, position with slider 150 positioned such that protrusion 148 of latch 152 is located just past stop 122. Rocker 156 has been rotated by an inward press on the lower, outer portion of latch 152, as will be discussed in more detail below, so that protrusion 148 is rotated outward to clear stop 122. The outward position of protrusion 148 allows slider 150 to move upward along the front side 120 of housing 110. Rib 134 is positioned above bottom rim 124 and has slid past tablet 178*a* located in recess 180. The ramped upper portion of rib 134 has engaged tablet 178*b* and moved it upward.

Figure 5B:
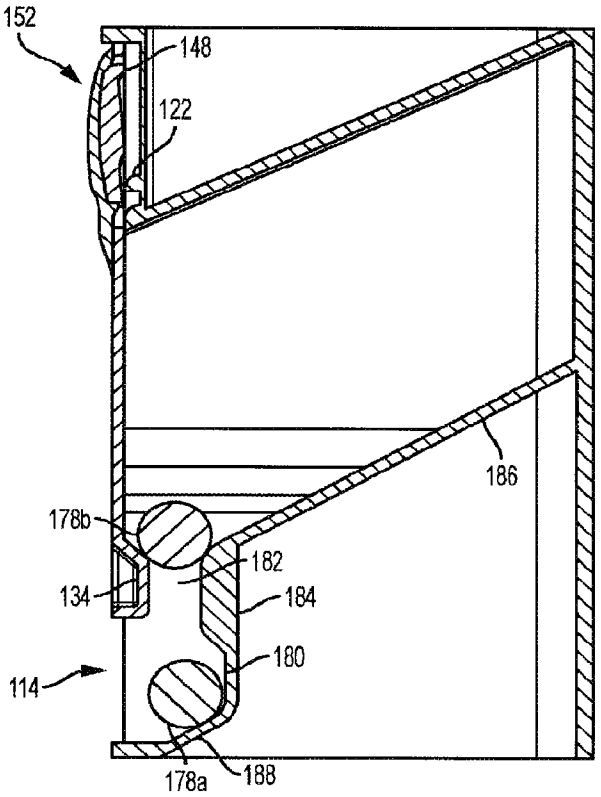
FIG. 5B is a sectional view of the dispenser of FIG. 5A.
Figure 5A:
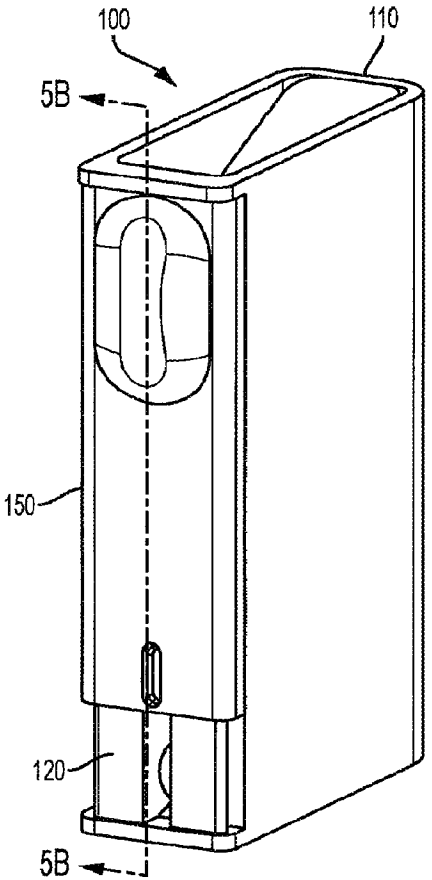
FIG. 5A is a front perspective view of the dispenser of FIG. 3A in a dispensing state.

FIGS. 5A and 5B are perspective and cross sectional views, respectively, illustrating dispenser 100 in its dispensing configuration with slider 150 positioned at the top of front side 120 of housing 110. The lower portion of chute 114 is uncovered, such that tablet 178*a* can emerge from the front of dispenser 100. Ramp 188 may be provided at the bottom of chute 114 to urge tablet 178*a* forward out of chute 114 and into a user's hand, thus completing the dispensing of a single unit of product. Tablet 178*b* is retained within dispenser 100 by the narrowness of the passage between rib 134 and necking wall 184. During the upward motion of slider 150, tablet 178*b* is moved upward to the position illustrated in FIG. 5B. The narrowness of the passage between rib 134 and necking wall 184 creates a pinch point that tablet 178*b* cannot enter, ensuring that only one unit of product can be dispensed.

From the dispensing position, slider 150 may return to its closed configuration by sliding downward. This return may be effected by a user applied force or may be effected by an automatic return force provided by a spring or other resilient member. For example, a torsion spring may be affixed at one end to the housing and at the other end to the slider such that the spring is further torqued as slider 150 moves to the dispensing position, which provides a return force to return slider 150 to its closed position. As slider 150 moves downward, tablet 178*b* rests against the sloped upper end of rib 134 such that it follows the downward motion of slider 150. Tablet 178*b* slides down through necking section 182 and into the now-vacant recess 180 just as slider 150 moves into its latched position in which chute 114 is closed off.

Figure 6C:
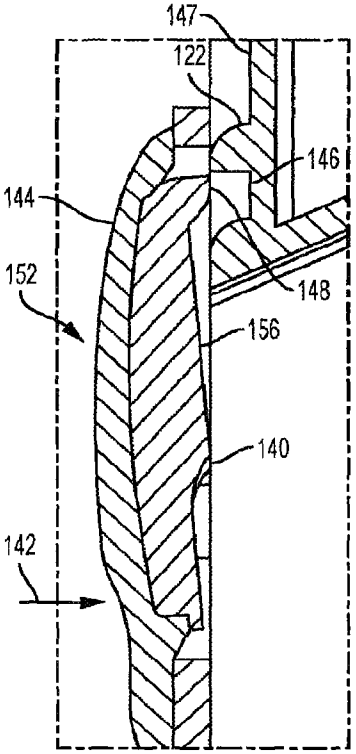
FIG. 6C is an enlarged view of the latch portion of the dispenser of FIG. 6A in an unlatching position, according to some embodiments.
Figure 6B:
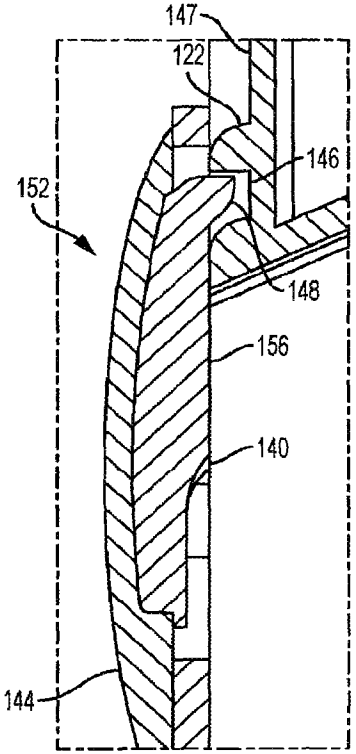
FIG. 6B is an enlarged view of the latch portion of the dispenser of FIG. 6A in the latched position, according to some embodiments.
Figure 6A:
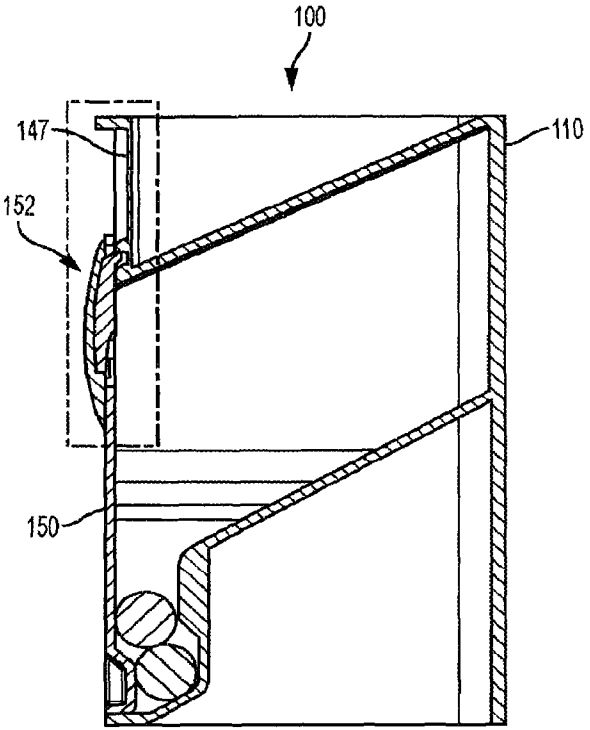
FIG. 6A is a sectional view of a dispenser in a closed state, according to some embodiments.

FIGS. 6A-6C are cross sectional views of dispenser 100 illustrating the unlatching of latch 152. FIG. 6B is an enlarged cross sectional view showing latch 152 in its latched position and FIG. 6C is an enlarged cross sectional view showing latch 152 in its unlatched position. In the latched position, protrusion 148 extends into lower recess 146 in housing 110. Stop 122 is located at the upper end of lower recess 146. Upward motion of slider 150 is prevented by the engagement of the upward facing surface of protrusion 148 and the opposing surface of stop 122.

Latch 152 may include a cover layer 144 that overlays rocker 156. An inward press on the lower portion of cover layer 144, as indicated by arrow 142, may cause rocker to rock about pivot 140 such that the rocker rotates counter-clockwise in the illustrated views. A user may apply this inward press by wrapping fingers of a hand around the side and back of housing 110, placing the thumb of the hand on cover layer 144 and pressing inwardly on cover layer 144 with the thumb, to cause the rocker 156 to pivot out of its latching position.

As rocker 156 pivots, the lower portion of rocker 156 rotates inwardly and the upper portion rotates outwardly such that protrusion 148 comes out of lower recess 146, as illustrated in FIG. 6C. This is the unlatched position in which protrusion 148 has cleared stop 122. Once rocker 156 is in this position, slider 150 can be moved upward by the user modifying the press on the lower portion of cover layer 144 to include an upward direction. This combined inward and upward force and motion required to slide the slider 150 upward serves as a child-resistant feature. Latch 152 may be configured such that the force required to sufficiently rotate rocker 156 and/or slide slider 150 upward may be difficult for a child to exert, which may serve as an additional child-resistant feature. Thus, to overcome the child-resistant features, according to some embodiments, a user applies a press and push combination of movements to the dispenser. As is apparent, the press operation to unlatch the latch is generally perpendicular to the push operation for sliding the slider to its dispensing position. These distinct operations may be generally difficult for children to perform.

In some embodiments, if the rotating force is released from latch 152 once protrusion 148 has moved upward past stop 122, rocker 156 will rotate back to its non-rotated position and protrusion 148 will extend into upper recess 147 above stop 122 on front side 120 of housing 110. As slider 150 moves back downward with rocker 156 in this non-rotated position, the lower surface of protrusion 148 will contact the upper surface of stop 122. The lower surface of protrusion 148 and/or the upper surface of stop 122 may be configured such that the rocker 156 is urged to a rotated position, allowing protrusion 148 to ride over and past stop 122. For example, the facing surfaces of protrusion 148 and stop 122 may be curved and/or sloped as illustrated in FIGS. 6A-6C. In some embodiments, the upper recess is not provided, and protrusion 148 remains in a rotated position, resting against and sliding along the surface of the front side 120 during the movement of slider 150 into and from the dispensing position until protrusion 148 snaps back into lower recess 146.

Figure 7:
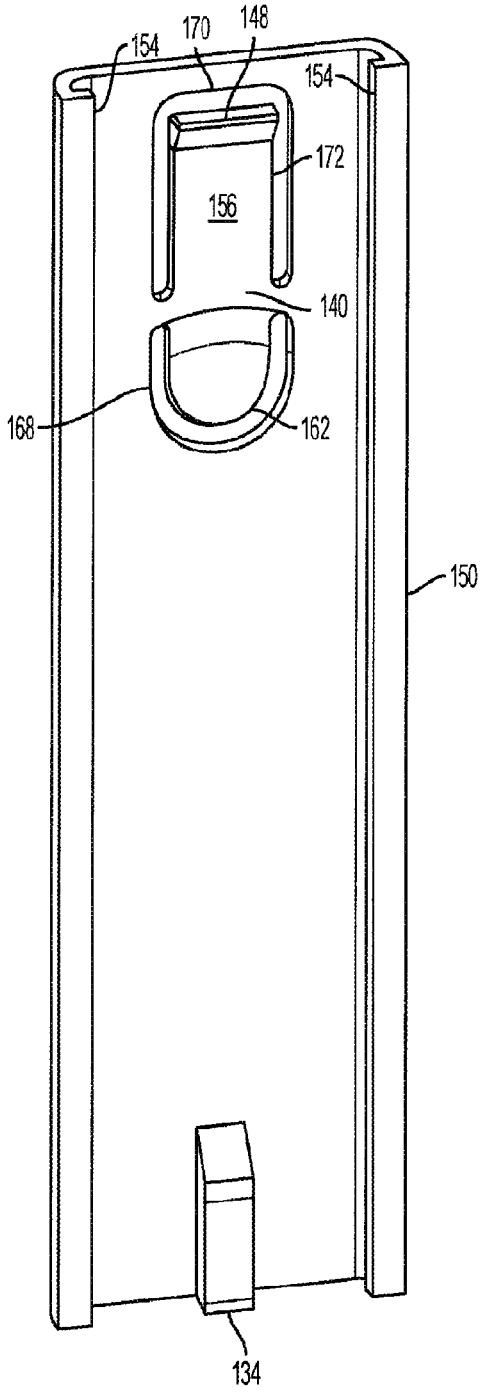
FIG. 7 is a rear perspective view of a slider, according to some embodiments.

FIG. 7 is a rear perspective view of slider 150 illustrating the structure of rocker 156, according to some embodiments. Rocker 156 may be formed as a portion of slider 150 by forming two U-shaped cutouts in the main body of slider 150. The upper portion 172 of rocker 156 is formed by upper cutout 170 and lower portion 162 of rocker 156 is formed by lower cutout 168. The portion of the main body of slider 150 between cutouts 168 and 170 forms pivot 140, which twists as rocker 156 pivots to the unlatched position and urges rocker 156 to its non-pivoted orientation. Lower portion 162 of rocker 156 acts as a lever arm enabling a user press on the lower portion 162 (for example, via cover layer 144) to generate sufficient torque to pivot upper portion 172 such that protrusion 148 moves out of lower recess 146 of housing 110 to unlatch slider 150. In some embodiments, rocker 156 may be a separate piece from the main body of slider 150. In some embodiments, one or more resilient members may be used to pivotally affix rocker 156 to slider 150. For example, a resilient band or torsion spring may be attached to the slider and rocker so that the rocker can pivot relative to the slider and is urged to its latched angular orientation.

As illustrated in FIG. 1, a cover layer 144 may overlie the rocker. Cover layer 144 may be formed of an elastic material, such as any suitable thermoplastic elastomer, that can deform as rocker 156 pivots between its latched and unlatched positions. Cover layer 144 may serve as an indication to the user of where to apply pressing and sliding forces for dispensing and may provide an increased surface area to facilitate a user's application of force to rocker 156 and/or provide an ergonomic interface for the user. Cover layer 144 may be affixed to slider 150 in any suitable way including by gluing and/or by press fitting one or more protrusions into corresponding cutouts in slider 150. In some embodiments, no cover layer 144 is provided such that the user directly engages rocker 156. In some embodiments, cover layer 144 is provided just on the lower portion 162 of rocker 156.

Figure 8:
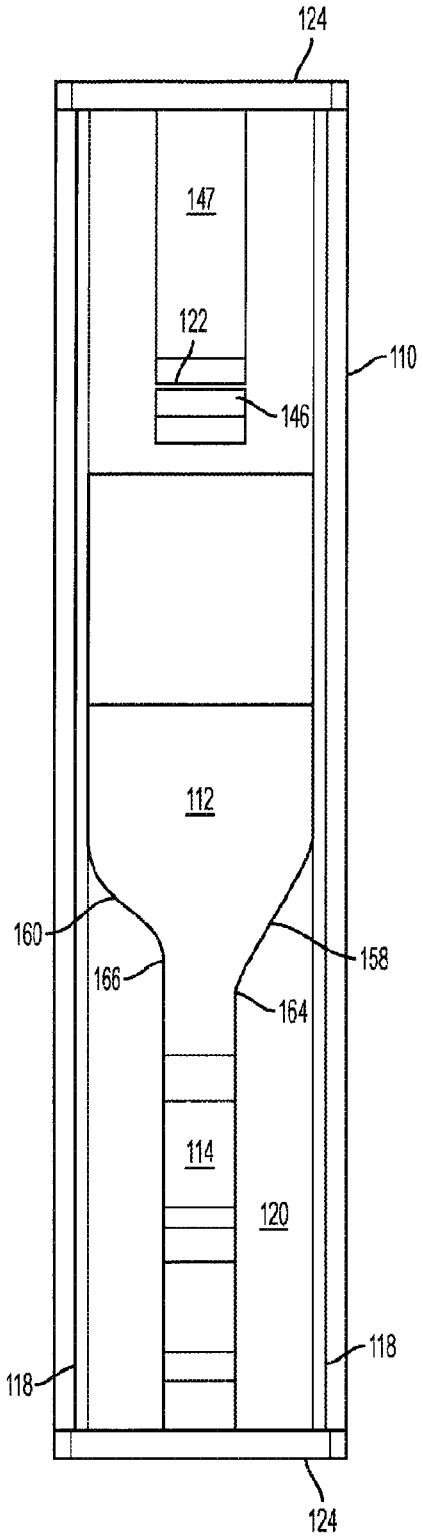
FIG. 8 is a front view of a dispenser housing, according to some embodiments.

FIG. 8 is a front view of dispenser 100 with slider 150 removed to illustrate features of chamber 112. To guide product into chute 114, housing 110 includes a first guide wall 158 on one side of the chute and a second guide wall 160 on the opposite side of the chute. The meeting point 164 between the first guide wall 158 and chute 114 is at a lower position than the meeting point 166 between the second guide wall 160 and chute 114. This offset arrangement helps orient the product vertically as it enters the chute. The amount of offset and the slope angles of the guide walls 158 and 160 can be tailored to the shape of the product. In some embodiments, additional guiding features are provided within chamber 112 to properly orient product as it enters the chute, such as guiding vanes that project from the side and/or back walls. Thus, dispenser 100 relies on a combination of housing configuration and gravity to guide product into the dispensing position within chute 114. Generally, chute 114 is configured to extend vertically to maximize gravity's effect on the movement of product through the chute when the dispenser is in its nominal position. However, chute 114 may be oriented non-vertically so long as gravity acts to urge product along the chute to the dispensing end.

Dispenser 100 is illustrated with dispensing chute 114 centrally located toward the front side of the housing and configured to dispense a unit of product from the front side of the housing. However, the dispensing chute may be located anywhere in the housing and may dispense product in any direction. For example, the dispensing chute may be located on either lateral side of the housing or the back of the housing.

Embodiments can be configured to contain and dispense any size and shape of product in any quantity. Exemplary product shapes include pills, tablets, spheres, orbs, coins, cubes, beads, ovoids, obloids, cylinders, and the like. Cross-sectional shape of the products can vary, and exemplary cross-sectional shapes include circles, squares, ovals, rectangles, triangles, and the like. Dimensions of the product may vary depending on its shape. An example of product, according to some embodiments includes a tablet-shaped product that has a diameter of about 6.4 mm and a thickness of about 3.4 mm Diameters of typical product can include diameters of at least 4 mm, at least 5 mm, at least 6 mm, at least 7 mm, or at least 10 mm Diameters of typical product can include diameters of at most 6 mm, at most 8 mm, at most 10 mm, at most 15 mm, or at most 20 mm Thickness of typical product can include thicknesses of at least 0.5 mm, at least 1 mm, at least 1.5 mm, at least 2 mm, or at least 2.25 mm Thickness of typical product can include thicknesses of at most 2 mm, at most 3 mm, at most 5 mm, at most 10 mm, or at most 15 mm. The number of product units stored in the dispenser, according to various embodiments, may vary depending on the size of the dispenser, the size of the product units, and/or the recommended dosage. For example, a dispenser for a 30-day supply of a pharmaceutical dosed at one unit once per day may include 30 units, whereas a dispenser for a 30-day supply of a pharmaceutical dosed at one unit twice per day may include 60 units. Typically, quantities of product will typically be in the range of about 5 to about 500 units and, more typically, from about 5 to about 100 units.

The outer shape of the dispensers can vary without departing from the principles discussed above. Although the dispenser embodiments illustrated in the drawings have certain contours, dispensers with other exterior surface designs could also be used. Any sides or edges of the dispensers according to various embodiments may be flattened, rounded, and/or beveled. Various surfaces or edges of the dispenser could be concave or convex. Opposing sides, ends, or edges of the dispenser can be parallel or non-parallel such that the dispenser becomes narrower in one or more dimensions.

Dimensions of the dispensers described herein can vary without departing from the invention. In preferred embodiments, the dispensers have a size suitable for handheld manipulation and operation. For example, according to some embodiments, the dispenser may be sized to fit in a typical adult hand and to enable the child-resistant features to be overcome with the fingers of a typical adult hand, as described above. Exemplary dimensions for handheld embodiments include heights (the dimension from the top to the bottom of the dispenser) in the range of about 50 mm to about 200 mm, preferably about 60 mm to about 150 mm, and more preferably about 70 mm to about 100 mm Exemplary widths (the dimension across the side of the housing upon which the slider is disposed) include the range of about 20 mm to about 150 mm, preferably about 30 mm to about 100 mm, and more preferably about 40 mm to about 60 mm Exemplary depths can range from about 5 mm to about 50 mm, preferably about 10 mm to about 30 mm, and more preferably about 15 mm to about 25 mm. In some embodiments, the size of the dispenser may be selected to provide enough room for labelling, such as dosage labelling, government required labelling, etc.

Dispensers may be constructed of any suitable material. Examples of suitable materials include metal, wood, cardboard, laminate paperboard, corrugated paper, plastics, and combinations thereof. Suitable plastics include low density polyethylene (LDPE), polypropylene (PP), polyacetal (POM), Nylon, thermoplastic elastomer, and polyvinyl chloride (PVC). Other plastic materials may also be suitable. In some embodiments, the dispenser may be made by any method and from any plastic material that facilitates mass-production at a low unit cost while having strength and resilience suitable for secure storage of products in shipping, warehousing, retailing, and consumer use environments. Materials may be selected for ability to be impermeable, chemically inert, stable, and/or compatible with the product to be contained and with the environment in which the dispenser will be used. Different portions of the dispenser may be constructed from different materials. For example, the housing may be constructed of one material while the slider is constructed from a different material. Different portions of the dispenser may also be produced according to different methods. For example, the slider may be molded as a single continuous piece, whereas the housing may be constructed from multiple molded pieces that are then attached together, such as by gluing.

A method for filling a dispenser, according to some embodiments, may include orienting the housing with the front side 120 facing vertically upward and then filling chamber 112 through the open front side (which is facing vertically upward) from above. Once chamber 112 is filled, slider 150 may be placed on the front side and pressed downward such that the runners snap into place, wrapped around the rails. Slider 150 may then be slid toward the bottom of the dispenser into the closed position. The dispenser may then be packaged (for example, for shipping, display at retail stores, etc.).

As part of a final packaging process, once a dispenser is filled with the desired product, the dispenser or multiple dispenser can be over-wrapped or over-sealed with a film material, or shrink-wrapped with such a material. The outer packaging material can vary, and the selection of packaging is typically based on factors such as aesthetics, transparency, comfort of handling, desired barrier properties (e.g., so as to provide protection from exposure to oxygen or radiation, or so as to provide protection from moisture transfer), and the like. Packaging material may be in the form of a film, such as a laminated film. Representative materials that can be used to provide components or layers of film materials or laminated films include polyvinyl chloride, ethylene vinyl acetate co-polymer, oriented polypropylene, linear low density polyethylene, polyvinylidene dichloride, polyester terephthalate, ethylene methacrylic acid co-polymer, metallacene linear low density polyethylene, cellulosic materials (e.g., cellophane), and the like. Exemplary packaging materials include plastic/metal films, plastic/metal films that are paper coated, plastic laminate films, paper or cardboard boxes or backing, and the like.

Accordingly, child-resistant single product unit dispensers may be provided that can be made at a low cost. Dispensers, according to the above features, can have as few as two primary components that can be made easily and cheaply. Dispensers can be permanently closed such that product access is restricted to product that is dispensed through the dispensing processes described above. Consumers cannot gain access to the main compartment holding the product (e.g., consumers cannot gain access to the main compartment without a tool or without breaking the dispenser).

The child-resistant feature of dispensers, according to the above principles, requires a two-step process to dispense product that is difficult for young children to perform. Moreover, overcoming the two-step child resistant feature results in access to only a single unit of product. Thus, dispensers according to some embodiments provide enhanced child resistance compared with conventional twist-and-press cap pharmaceutical containers. Additionally, dispensers, according to the above features, easily dispense a single unit of product, which is advantageous over many conventional screw cap bottles in which a user may have difficulty pouring just a single unit out of an opened bottle.

The foregoing description, for the purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying figures, it is to be noted that various changes and modifications will become apparent to those skilled in the art. Such changes and modifications are to be understood as being included within the scope of the disclosure and examples as defined by the claims. Finally, the entire disclosure of the patents and publications referred to in this application are hereby incorporated herein by reference.

What is claimed is:

1. A child-resistant dispenser comprising:

a housing; and a slider disposed on the housing and configured to slide from a closed position to a dispensing position, the slider comprising a movable engagement portion that engages a stop on the housing, wherein the engagement between the movable engagement portion and the stop restricts movement of the slider to the dispensing position and the movable engagement portion is configured to disengage from the stop in response to a release force applied to the slider, wherein the housing comprises a dispensing chute, and the dispenser is configured to dispense a single unit of product from the dispensing chute when the slider is in the dispensing position, wherein the slider comprises a protrusion that restricts additional product from moving to a dispensing location in the dispensing chute when the slider is in the dispensing position, and wherein the dispensing chute comprises a recess for accommodating a single unit of product, and the recess is aligned with the protrusion when the slider is in the closed position.

2. The dispenser of claim 1, wherein the housing comprises a first sloping wall that intersects the dispensing chute at a first location and a second sloping wall that intersects the dispensing chute at a second location and the first location is offset relative to the second location to orient product for entering the dispensing chute.

3. The dispenser of claim 1, wherein the dispenser is a handheld dispenser.

4. The dispenser of claim 1, wherein the dispenser is configured for single-handed dispensing.

5. The dispenser of claim 1, wherein the dispenser is configured to dispense in response to a combined inward and upward force applied to the slider by a hand.

6. The dispenser of claim 1, wherein the movable engagement portion disengages from the stop by moving outward from the housing.

7. The dispenser of claim 1, wherein the slider is configured to slide along rails on the housing.

8. The dispenser of claim 1, wherein the slider is configured to slide to the dispensing position in response to application of a dispensing force applied to the slider when the movable engagement portion is disengaged from the stop, and the slider is restricted from sliding to the dispensing position in response to application of the dispensing force to the slider when the movable engagement portion is engaged with the stop.

9. The dispenser of claim 8, wherein the dispenser is configured such that the release force and the dispensing force are applied at a single location on the slider.

10. The dispenser of claim 1, wherein the slider comprises a pivoting member and the movable engagement portion is located at an end of the pivoting member.

11. The dispenser of claim 10, wherein the slider comprises a main body and the pivoting member is resiliently affixed to the main body such that the pivoting member is biased toward engagement with the stop.

12. The dispenser of claim 11, wherein the main body and the pivoting member are formed as a unitary piece.

13. The dispenser of claim 11, wherein the slider comprises a connection between the main body and the pivoting member that is configured to twist as the pivoting member pivots.

14. The dispenser of claim 1, wherein the dispenser is pre-filled.

15. The dispenser of claim 14, further comprising packaging encasing the housing and the slider.

16. A method of dispensing a unit of product from a dispenser that comprises a housing and a slider disposed on the housing, the method comprising:

moving at least a portion of an engagement portion of the slider to release an engagement between the slider and the housing that prevents the slider from moving to a dispensing position; and while the engagement is released, moving the slider along a side of the housing to from a closed position to the dispensing position in which a single unit of product is dispensed, wherein the housing comprises a dispensing chute, and the dispenser is configured to dispense a single unit of product from the dispensing chute when the slider is in the dispensing position, wherein the slider comprises a protrusion that restricts additional product from moving to a dispensing location in the dispensing chute when the slider is in the dispensing position, and wherein the dispensing chute comprises a recess for accommodating a single unit of product, and the recess is aligned with the protrusion when the slider is in the closed position.

17. A child-resistant dispenser comprising:

a housing; and a slider disposed on the housing and configured to slide from a closed position to a dispensing position, the slider comprising a movable engagement portion that engages a stop on the housing, wherein the engagement between the movable engagement portion and the stop restricts movement of the slider to the dispensing position and the movable engagement portion is configured to disengage from the stop in response to a release force applied to the slider wherein the slider comprises a pivoting member and the movable engagement portion is located at an end of the pivoting member, wherein the slider comprises a main body and the pivoting member is resiliently affixed to the main body such that the pivoting member is biased toward engagement with the stop, and wherein the slider comprises a connection between the main body and the pivoting member that is configured to twist as the pivoting member pivots.

* * * * *